United States Patent [19]

Mohrman

[11] 4,447,944

[45] May 15, 1984

[54] METHOD OF FORMING A TUBULAR RIVET IN FASTENING RELATION TO A PLURALITY OF LAMINATES

[75] Inventor: Robert H. Mohrman, Bridgeton, Mo.

[73] Assignee: The United States of America as represented by the Secretary of the Navy, Washington, D.C.

[21] Appl. No.: 389,138

[22] Filed: Jun. 16, 1982

[51] Int. Cl.[3] ..... B21D 39/00; B23P 11/00

[52] U.S. Cl. ..... 29/512; 29/522 A; 29/523; 29/526 R; 411/41; 411/43; 411/70; 403/277

[58] Field of Search ..... 29/523, 522 A, 512, 29/526 R; 403/277; 411/54, 70, 41, 43, 44

[56] References Cited

U.S. PATENT DOCUMENTS

| | | | |
|---|---|---|---|
| 2,146,461 | 2/1939 | Bettington | 29/523 UX |
| 2,233,820 | 3/1941 | Pavlecka . | |
| 2,293,491 | 8/1942 | Cox | 29/523 UX |
| 2,371,423 | 3/1945 | Buchet | 29/523 UX |
| 2,371,452 | 3/1945 | Lees, Jr. . | |
| 2,384,321 | 9/1945 | Lees, Jr. | 411/41 |
| 2,385,886 | 10/1945 | Shaff | 411/43 |
| 2,389,479 | 11/1945 | Austin . | |
| 2,465,144 | 3/1949 | Wyatt | 29/523 UX |
| 2,756,624 | 7/1956 | Austin | 411/43 |
| 2,774,098 | 12/1956 | Tieri . | |
| 2,956,334 | 10/1960 | Stewart | 29/523 X |
| 3,038,626 | 6/1962 | Simmons . | |
| 3,257,890 | 6/1966 | Kraemer | 411/43 |
| 3,302,510 | 2/1967 | Gapp | 29/523 X |
| 3,489,056 | 1/1970 | Blakeley . | |
| 3,657,957 | 4/1972 | Slebol . | |
| 3,915,055 | 10/1975 | Binns | 411/41 |
| 3,959,866 | 6/1976 | Biddle et al. | 29/523 X |
| 4,164,807 | 12/1979 | King, Jr. | 29/523 |
| 4,221,041 | 9/1980 | Hufnagl et al. | 29/512 |

FOREIGN PATENT DOCUMENTS

| | | | |
|---|---|---|---|
| 571207 | 12/1957 | Italy | 411/44 |
| 418065 | 2/1967 | Switzerland | 29/523 |
| 471413 | 9/1937 | United Kingdom | 29/523 |

*Primary Examiner*—Charlie T. Moon

*Attorney, Agent, or Firm*—Robert F. Beers; Harvey A. David

[57] ABSTRACT

A tubular rivet is formed having flared conical head portions in fastening relation to a plurality of laminates presenting outer surfaces that are inclined to planes normal to a bore through the laminates and having countersinks the axes of which are normal to the respective outer surfaces by means of a mandrel having a conical forming head on a bendable pull shaft extending through an annular anvil having a conical forming surface and adapted to swivel relative to the pull shaft.

1 Claim, 4 Drawing Figures

METHOD OF FORMING A TUBULAR RIVET IN FASTENING RELATION TO A PLURALITY OF LAMINATES

BACKGROUND OF THE INVENTION

This invention relates to the filed of rivets and their forming, and more particularly to tubular rivets, methods and tools suitable for fastening fiber reinforced plastic laminates to one another or to metal. The use of rivets to fasten fiber reinforced plastic laminates, for example those using glass, graphite, or boron fibers has incurred a recognized problem of stress crazing resulting from the formation or setting of a rivet head, particularly, but not exclusively, in use of blind-formed rivets in which a bulbous head is typically formed on the blind side.

U.S. Pat. No. 4,221,041 to G. Hufnagl et al discloses a semi-tubular rivet with conical heads used in fastening fiber reinforced laminates which have been previously countersunk. The rivet described in that patent requires access from both sides of the work.

The problem of undue and damaging stresses being set up during the setting of rivets in laminates of the type concerned is magnified when one or both of the laminate exterior surfaces are not normal to the axis of the preformed rivet hole and the principal axis of the rivet.

SUMMARY OF THE INVENTION

With the foreoging in mind, a principal object of the invention is to provide an improved rivet for fastening fiber reinforced plastic laminates.

Another object of the invention is to provide a method for blind forming a tubular rivet having conical heads at both ends engaged in countersinks.

As still another object the invention aims to provide a blind formed tubular rivet wherein the conical heads are seated in countersinks in surfaces, one or both of which are not normal to the axis of the rivet body and the rivet hole.

Yet another object is to provide the mentioned tubular rivet and method wherein one of the heads is partially preformed.

A further object is to provide a tubular rivet for fastening laminates together with non-parallel exterior surfaces, conically countersunk with the counter sinking axes substantially normal to the corresponding exposed laminate surfaces to accept substantially conical rivet heads, and rivet setting tool means including proximal and distal head forming anvil and mandrel members that are adapted to assume off-axis positions relative to the rivet and hole axis.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENTS

Figure 1:
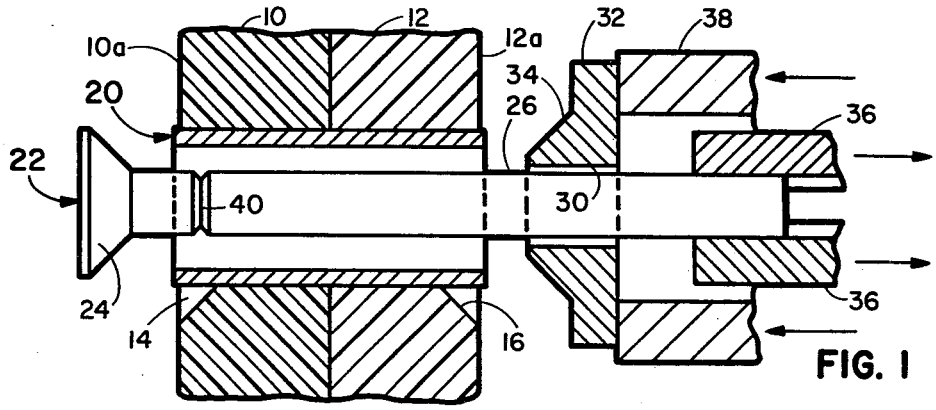
FIG. 1 is a fragmentary sectional view illustrating pre-drilled and countersunk laminates about to be fastened by a tubular rivet and method according to this invention.

Referring to FIG. 1, 10 and 12 are layers or laminates of materials such as graphite fiber reinforced plastic to be fastened together by a tubular rivet. The laminates 10 and 12*a*, which present substantially parallel outer surfaces 10*a* and 12*a*, have been drilled and countersunk at 14 and 16 to accept a tubular rivet on an axis substantially normal to those outer surfaces. A simple, sleeve shaped tubular rivet 20 is inserted into the hole so as to project into the countersinks 14 and 16. A mandrel, generally indicated at 22, has a conical, remote or distal rivet end forming head 24 and a shaft 26. The shaft 26 extends through the lumen of the rivet 20, through the center opening 30 of a near or proximal rivet end forming anvil 32 having a conical forming face 34, and is adapted to be gripped by jaws 36 of a pulling chuck or collet. The jaws 36 form part of a hand-held rivet setting tool, for example, and are adapted to be forcefully moved thereby relative to an annular anvil pressing thrust collar 38. The mandrel head 24 is conveniently of the same outside diameter as the unformed rivet 20 when used in blink riveting, as in this example, but can be larger when access to the far side is available. Also, in the present example, the shaft 26 is preferably provided with a weakened location or breakaway groove 40. The rivet 20 is of suitable ductile metal or metal alloy the strength and characteristics of which are selected in the usual manner for the use contemplated. The mandrel 22 is also metallic but may be of a different metal or characteristics.

Figure 2:
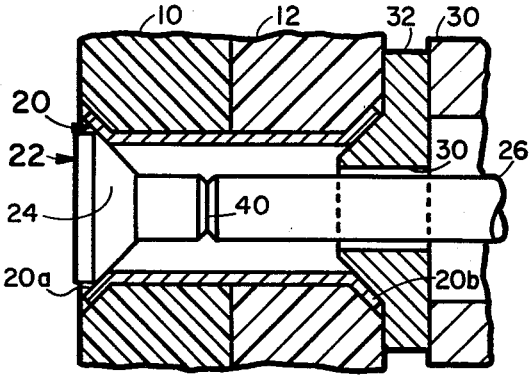
FIG. 2 is a gragmentary sectional view similar to FIG. 1, but showing the rivet in formed condition with the forming tools still in place.

Referring now to FIG. 2, the rivet 20 has been set, the ends thereof having been flared by the mandrel head 24 and the anvil 34 to form substantially conical rivet heads 20*a* and 20*b* in the countersinks 14 and 16 respectively. By increasing the pull on shaft 26 it is caused to fracture at 40 and the anvil 32, thrust collar 38, and the portion of shaft 26 held by the jaws 36 can be removed. The head portion of the mandrel 22 can either be left in place, or removed.

In some circumstances, it may be desirable to provide the proximal end of the rivet 20 with a partially preformed conical head to promote process. At times the rivet hole may not be drilled normal to the laminate surfaces, and the countersinks may be tilted or slightly off-center. The described rivet and method adapt to these circumstances to effect a snug fastening. To this end, it will be noted that the shaft portion 26 of the mandrel 22 is slender relative to the rivet lumen, so as to flex as necessary to permit the head 24 to tilt slightly. Also, the bore 30 of the anvil 32 provides sufficient clearance around the shaft 26 to permit axial alignment and inclination of the anvil to accommodate some aberrations in the bore and countersink during forming of the rivet head 20*b*.

Figure 3:
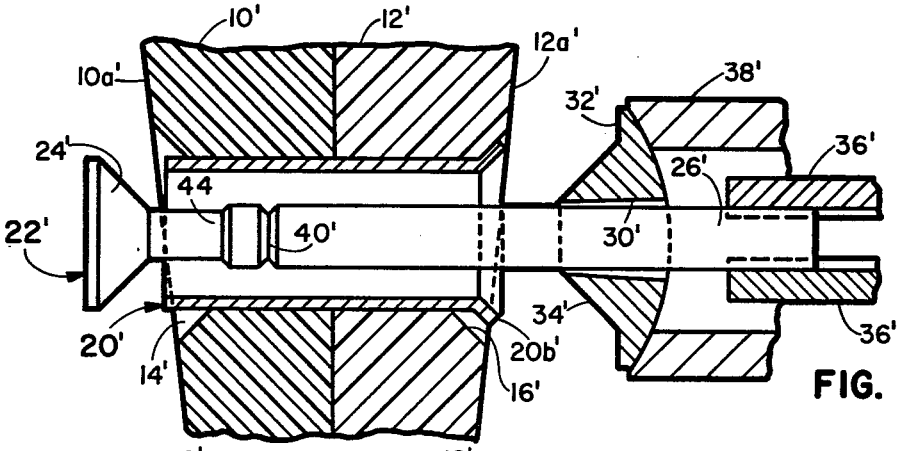
FIG. 3 is a fragmentary sectional view illustrating laminates having non-parallel faces about to be fastened by a rivet, method and tooling according to this invention.
Figure 4:
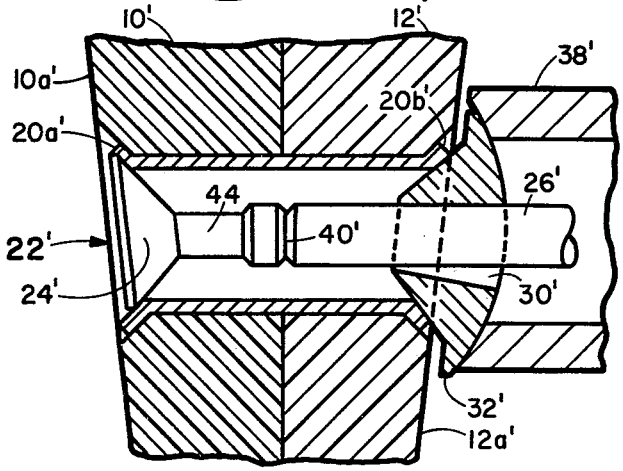
FIG. 4 is a fragmentary sectional view similar to FIG. 3, but showing the rivet in formed condition with the tooling still in place.

Larger inclinations of one or both of the exposed work surfaces of the laminates and of the axes of the countersinks relative to the rivet body are readily accommodated by the embodiment of the invention shown in FIGS. 3 and 4. Referring to FIG. 3, laminates 10' and 12' have exposed faces 10a' and 12a' that are inclined relative to one another, or to a plane that is normal to the axis of a rivet hole and a rivet 20' therein. In FIG. 3 the rivet 20' has been provided with a partially formed head 20b'. The rivet hole is provided with counter sinks 14' and 16', the axes of these countersinks being normal to the exposed surfaces 10a' and 12', respectively, rather than aligned with the rivet hole axis.

In this example now being described, the mandrel 22' includes a shaft 26' that has been reduced at 44 adjacent the conical forming head 24'. Also, the anvil 32' and the thrust collar 38' are provided with cooperating convex and concave bearing surfaces 46 and 48, respectively, and the bore 30' is tapered, to permit free swiveling or tilting of the anvil while maintaining good thrust delivering contact of the thrust collar 38' therewith during operation of the pulling jaws 36'.

Referring now to FIG. 4, the rivet 20' has been set, and it will be noted that the shaft portion 44 has permitted the mandrel head 24' to tilt and form the rivet head 20a' to conform to the off-axis tilt of the countersink 14'. Similarly, it will be noted in FIG. 4 that the anvil 32' has swiveled to form the rivet head 20b' to the off-axis tilt of the countersink 16'. Again, application of increased force fractures the mandrel shaft at 40' to permit removal of the tooling and, if desired the mandrel head 24'.

Obviously, other embodiments and modifications of the subject invention will readily come to the mind of one skilled in the art having the benefit of the teachings presented in the foregoing description and the drawing.

It is, therefore, to be understood that this invention is not to be limited thereto and that said modifications and embodiments are intended to be included within the scope of the appended claims.

What is claimed is:

1. A method for forming a tubular rivet in fastening relation to a plurality of laminates one or both of which is tapered in thickness and through which laminates a rivet hole extends having first and second countersinks the axes of which are at small angles to the axis of said rivet hole, the method comprising the steps of:

providing in said hole a tubular rivet at least one end of which is unformed and the other end of which has a partially formed conical rivet head;

providing a forming mandrel having a head presenting a first conical forming surface adjacent said unformed end and having a shaft extending through the lumen of said rivet;

providing an annular anvil having a central bore through which said shaft extends and presenting a second conical forming surface to said partially formed conical rivet head;

said shaft being bendable adjacent said mandrel head and said bore of said anvil being tapered to permit tilting of said anvil relative to said shaft; and forcefully moving said mandrel head and said anvil toward one another so as to flare said one end and further flare said other end to form first and second conical rivet heads the axes of which are substantially coaxial with said axes of said countersinks.

* * * * *